United States Patent [19]

Feeney

[11] 3,944,229

[45] Mar. 16, 1976

[54] GOLF GAME

[76] Inventor: Thomas E. Feeney, 34 Sugar Toms Lane, East Norwich, Long Island, N.Y. 11732

[22] Filed: Jan. 7, 1975

[21] Appl. No.: 539,079

[52] U.S. Cl.273/134 AE; 273/134 DB; 273/134 CG

[51] Int. Cl.[2] ..... A63F 3/00

[58] Field of Search ..... 273/134

[56] References Cited

UNITED STATES PATENTS

| | | | |
|---|---|---|---|
| 2,238,079 | 4/1941 | Scheib | 273/134 AG |
| 3,130,973 | 4/1964 | Zapolski | 273/134 ES |
| 3,352,558 | 11/1967 | Lucas | 273/134 GM |
| 3,658,339 | 4/1972 | Boileau | 273/134 CG |
| 3,826,498 | 7/1974 | Monek | 273/134 AD |

FOREIGN PATENTS OR APPLICATIONS

| | | | |
|---|---|---|---|
| 737,062 | 9/1955 | United Kingdom | 273/134 CB |
| 914,886 | 7/1946 | France | 273/134 DB |

*Primary Examiner*—Delbert B. Lowe
*Attorney, Agent, or Firm*—Shlesinger, Arkwright, Garvey & Dinsmore

[57] ABSTRACT

A board golf game shows a typical golf course including the shape and layout of the holes with both natural and artificial hazards so as to exactly duplicate conditions encountered on the golf course. Playing pieces are moved to one of differently positioned, non-aligned, and marked yardage points which give the exact lie of the ball.

Dice, simulating clubs, and having different yardage values representing frequency and range of a given golf club, are selected and cast to obtain the yardage made by the stroke. This yardage is added to the previous yardage point value to determine total yardage and the corresponding yardage point to which the playing piece is to be moved.

Yardage points are also located at typical ball locations on the course, including hazards such as water and traps, to closely duplicate playing conditions. Instructions on the board and two sets of trap cards give a variety of possible recovery shots which can be expected.

A putting die gives the number of putts required to sink the ball after it lands on the green.

6 Claims, 11 Drawing Figures

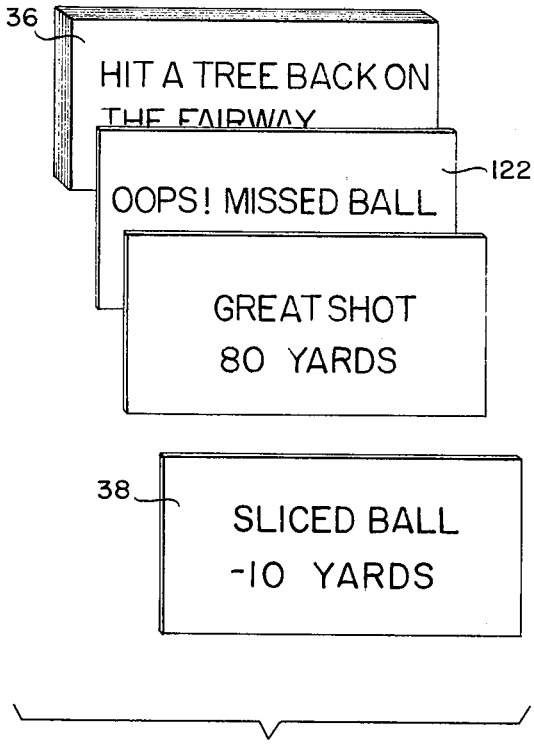
Fig. 7
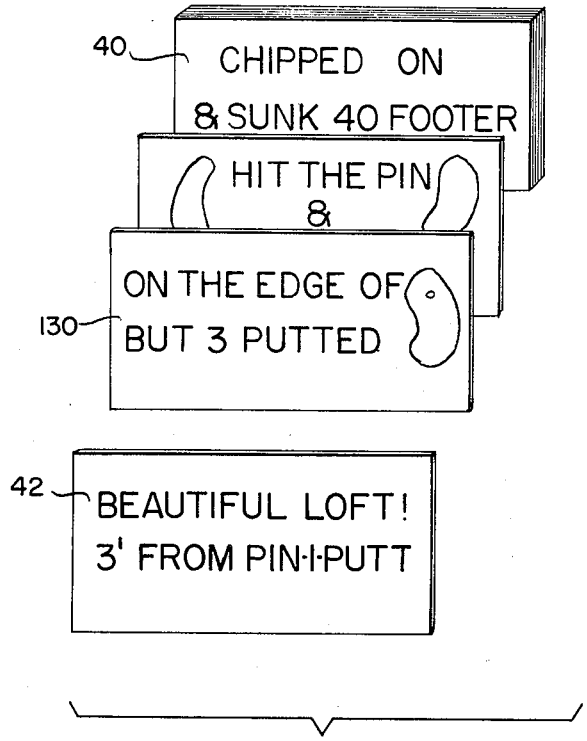
Fig. 8
66
| HOLE | PAR | PLAYERS | | | |
|---|---|---|---|---|---|
| | | RED | WHITE | BLUE | YELLOW |
| 1 | 3 | | 68 | | |
| 2 | 4 | 96 | 4 | 6 | 86 |
| 3 | 3 | | 4 | 1 | |
| 4 | 4 | | 4 | 5 | 114 |
| 5 | 4 | | 7 | 7 | 132 |
Fig. 10
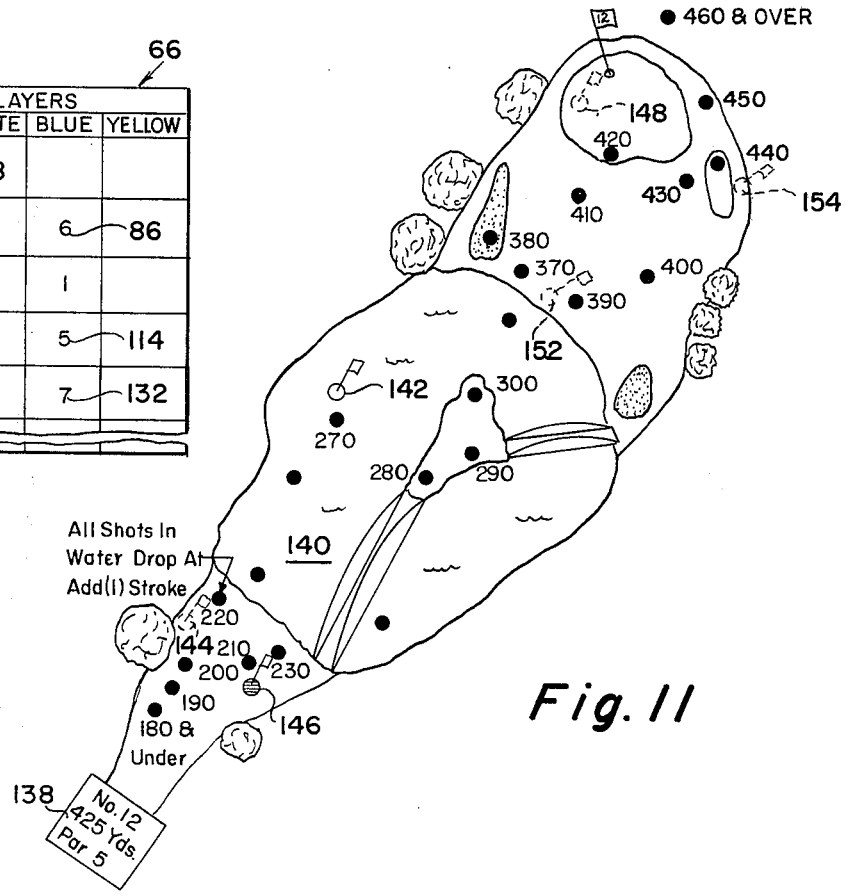
Fig. 11

No. 2
435 Yds
Par 4
No. 3
375 Yds
Par 4
No. 4
385 Yds
Par 4
No. 5
319 Yds
Par 4
470 & OVER
420 & OVER
260 & Over Add (1) Stroke
340 & Over Add (1) Stroke
Use Wedge Dice To Clear Trees
Trees Add (1) Stroke
HIGH DRIVE 60 YARDS
CHIPPED ON &(2) PUTTED

GOLF GAME

BACKGROUND OF INVENTION

This invention relates to a board-type golf game.

Many types of board golf games have been suggested in the past to duplicate the game of golf as played on a typical course. However, the previous games have lacked the simple and uncomplicated playing techniques necessary to hold player interest and simultaneously present to the players the many different types of situations actually encountered on the golf course.

More recently, several games, such as suggested in U.S. Pat. Nos. 3,658,339 and 3,826,498, respectively issued to Boileau and Monek, have been suggested, but these games only simplify play to some extent, and fail to present to the board player the actual playing situations encountered on the course. They also fail to require judgment of line of play, as on a regular course, or to provide the chance and variety of shots necessary to hold player interest.

SUMMARY OF INVENTION

Accordingly, one of the primary features of the subject golf game is to provide a simple, uncluttered, readily playable board golf game which more closely duplicates the actual play of a conventional game than heretofore proposed.

More complete golf course representation, and use of yardage points on the course, quickly spot the ball in the exact position on the course and permit the player to exactly size up the situation and make a judgment as to the desired line of play.

A feature of this invention involves the correlation of yardage point location and its yardage with the normally expected yardage distance determined from a given club under ordinary playing conditions.

Another feature of this invention is the use of dice representing certain golf clubs to obtain the desired yardage, the values on the dice being such that the yardage values obtained correspond to what could be expected by the use of such clubs on a regular golf course.

A further feature of this game is the correlation of the course layout and club selection so that a simple readily playable game is obtained which duplicates problems encountered on the golf course and requires golfer judgment and club selection dependent upon the lie of the ball and conditions of that particular hole.

A further feature is the use of sets of cards which introduce a variety of different recovery shots when the player's ball lands in a trap, such cards giving fairly typical results of the shot from the trap.

Use of both club dice and cards provides a fast moving and variable manner of moving the ball from the tee to the green under conditions resembling actual play which is uncomplicated and rapid, yet provides a wide number of golf shots exactly as could be anticipated in normal play on a regular course.

A putter die showing the number of putts required to sink the ball after it lands on the green, and numbered in accordance with average experience, expedites play on the green.

The combination of all of the above features results in a simple playable game in which golfers and non-golfers, and young and old can participate with equal interest and enthusiasm.

DESCRIPTION OF THE DRAWINGS

FIG. 7 is a perspective view of the set of fairway trap cards and which shows several of the cards.

FIG. 8 is a perspective view of the set of green trap cards showing several individual cards.

FIG. 10 shows a partially completed score card, reflecting play of the game illustrated in FIG. 9.

FIG. 11 illustrates play on one of the more difficult holes of the board.

DESCRIPTION OF THE INVENTION

Figure 1:
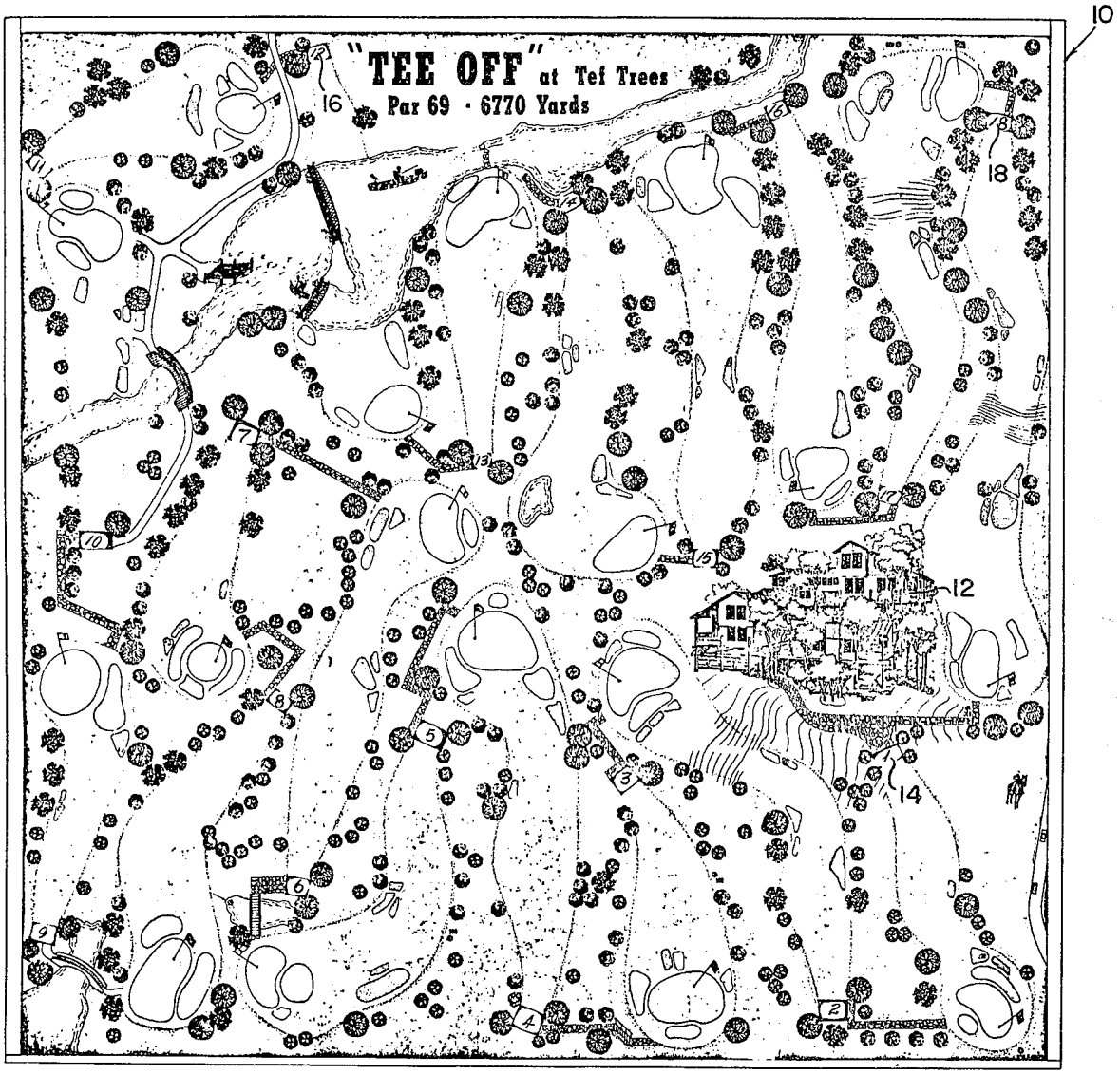
FIG. 1 shows the game board.

FIG. 1 gives an overall view of the game board 10 which shows an 18 hole, par 69 golf course of 6770 yards surrounding a Club House 12.

The first tee 14 is shown at the bottom of the Club House, and the first hole extends down to the lower right hand corner of the game board. The holes are laid out on the game board in a generally clockwise fashion, and extending around the Club House from the first hole. The course includes par 3, par 4 and par 5 holes as well as difficult water hole 16 at hole 12, and a long 605 yard 18th hole, 18. The shape of the hole, location and shape of the green, terrain, and obstacles such as trees, traps and water are clearly shown exactly as they would be encountered on a conventional golf course.

Figure 2:
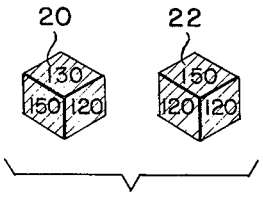
FIG. 2 is a perspective view of a pair of dice which represent the driving club.

FIG. 2 shows a pair of brown dice 20 and 22 representing the wood clubs. These dice have a total yardage range value of 240 to 300 yards. The total shown on the dice in FIG. 2 shows an upper range total of 280 yards. Each die is similarly marked, and has two faces showing 120 yards, two faces showing 130 yards, and one face each showing respectively, 140 and 150 yards. Yardage totals of 250, 260 and 270 yards each have a probability of turning up eight times out of 36 possibilities, while 280 yards will be obtained on five occasions, 240 yards on four occasions, and 290 yards on two occasions. There is only one chance in 36 of obtaining a 300 yard drive.

Figure 3:
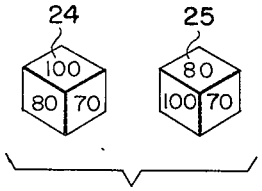
FIG. 3 is a perspective view of a pair of dice which represent an iron.

FIG. 3 shows a pair of white dice 24 and 25 which are used by the player as his iron. The yardage value totals for these dice range from 140 to 240 yards, in 10 yard increments. Each die has two faces carrying a 70 yard marking as well as two faces carrying an 80 yard marking. One face each carries 100 yard and 120 yard markings. Of the 36 possibilities over the 100 yard range between 140 and 240 yards, all of the yardage values up to and including 190 yards, with the exception of the 150 yard total, have four chances in 36 of being rolled. There are eight chances of getting a 150 yard total. There are five chances of getting a 200 yard total, while there are only two chances of getting 220 yards, and only one chance of getting 240 yards. The total yardage shown in FIG. 3 on the white dice is 180 yards.

Figure 4:
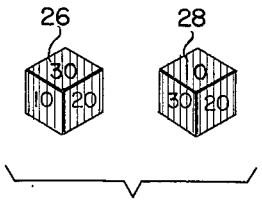
FIG. 4 is a perspective view of a pair of dice which represent a wedge club.

The wedge dice 26 and 28, which are red in color, are shown in FIG. 4. The range of total yardage for these dice is from 20 to 80 yards with the dice being heavily weighted toward the 20 to 50 yard total range where 30 of the 36 possibilities will fall. There are nine possibilities of rolling 20 yards, six of rolling 30 yards, and eight of rolling 50 yards. There are only three possibilities of rolling 60 yards, two of rolling 70 yards, and only one possibility of rolling 80 yards. The total yardage shown for the dice in FIG. 4 upon dice 26 and 28 is 40 yards. Each die has three faces with a 10, and one face each showing 20, 30 and 40 yard markings.

Figure 5:
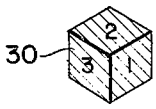
FIG. 5 is a perspective view of the die which represents the putter.

FIG. 5 shows the single green putting die 30 which is used by the player for his putter. The number on the putting die gives the number of putts required to sink the ball after it lands on the green. The numbers on the die faces, as with the previously discussed die faces, are made to conform to experience on the actual golf course. One of the six faces carries the numeral 1, while three faces carry the numeral 2, and two faces carry the numeral 3.

Figure 6:
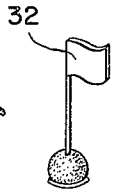
FIG. 6 shows a type of token which is moved along the game board by the player.

FIG. 6 shows a playing token 32, one of which is used by each player to mark the positin of his ball. The tokens are of different colors and can be of any configuration. It is also possible to place a magnet on the bottom of the token and use it with a magnetic board.

FIG. 7 shows the set of Fairway Trap Cards which are used by the player when his ball lands in a trap on the fairway. There are sixteen cards in the set, one of which is chosen by the player, instead of dice for his next shot. There are sixteen cards giving different and typical results of the player's shot from the trap. The cards carry one of the following legends:

| | |
|---|---|
| "DEEP LIE<br>USE (2) WEDGE DICE" | "OOPS! MISSED BALL<br>ADD (1) —TAKE CARD" |
| "GOOD SHOT<br>40 YARDS" | "SLICED BALL<br>–10 YARDS" |
| "HIGH DRIVE!<br>60 YARDS" | "HIT A TREE — BACK ON FAIRWAY<br>(–20 YDS.) |
| "GOOD SHOT<br>30 YARDS" | "YOU DIDN'T THINK! 'BACK IN<br>TRAP' +1 (TAKE ANOTHER CARD)" |
| "GREAT SHOT!<br>80 YARDS" | "YOUR ON THE GREEN" |
| "JUST 10 YDS. SHY<br>OF THE GREEN" | "MOVED BALL 6", ADD (1)<br>TAKE ANOTHER CARD" |
| "UNDER THE BALL<br>20 YARDS" | "TOPPED THE BALL<br>10 YARDS" |
| "ON THE EDGE<br>USE (1) WEDGE DIE" | "BAD SHOT!<br>10 YARDS" |

FIG. 8 shows the set of sixteen cards for the traps adjacent the green and designated Green Traps. If the player's ball lands in the green trap, instead of using the dice on his next shot he selects one of the Green Trap cards. The Green Trap cards contain the following legends:

| | |
|---|---|
| "ON GREEN<br>(2) PUTTED" | "CHIPPED ON & SUNK<br>A 40 FOOTER" |
| "!TOO HARD!<br>OVERSHOT GREEN BY 10 YDS." | "SAVED BY THE MOUND<br>BACK IN 2 PUTTS" |
| "BEAUTIFUL LOFT!!!<br>3' FROM PIN - 1 PUTT" | "CHOPPED! ADD A STROKE &<br>TAKE A CARD" (RELAX) |
| "BACK & FORTH ON THE GREEN<br>(5 PUTTS)" | "!!BEAUTIFUL!!<br>'RIGHT INTO CUP'" |
| "BALL RAN 12' PAST PIN<br>USE PUTTING DICE" | "!MISSED!<br>ADD (1) TRY AGAIN" |
| (EASY)<br>"CHIPPED ON GREEN &<br>(2) PUTTED" | "BARELY ON THE GREEN<br>USE PUTTING DIE" |
| "ON THE GREEN BUT<br>(4) PUTTED" | "HIT THE PIN<br>&<br>FELL IN!" |
| "ON THE EDGE OF GREEN<br>BUT...3 PUTTED" | "WOW! RIMMED THE CUP<br>(1) PUTT BACK<br>(CATCH A BREAK)" |

As with the case of the Fairway Trap Cards, an additional and varied means of moving the ball to the pin is introduced. With both sets of cards there are many different possibilities, both good and bad, and which could normally be expected as a shot. The thirty-two possibilities introduced by the two sets of trap cards cut down the repetitiveness of using only dice, and add a great deal of variety and interest to the game by introducing a different and unforeseeable chance factor. The cards also provide an expeditious manner of moving the ball along. In many instances, the card eliminates the need to use the putting die.

Figure 9:
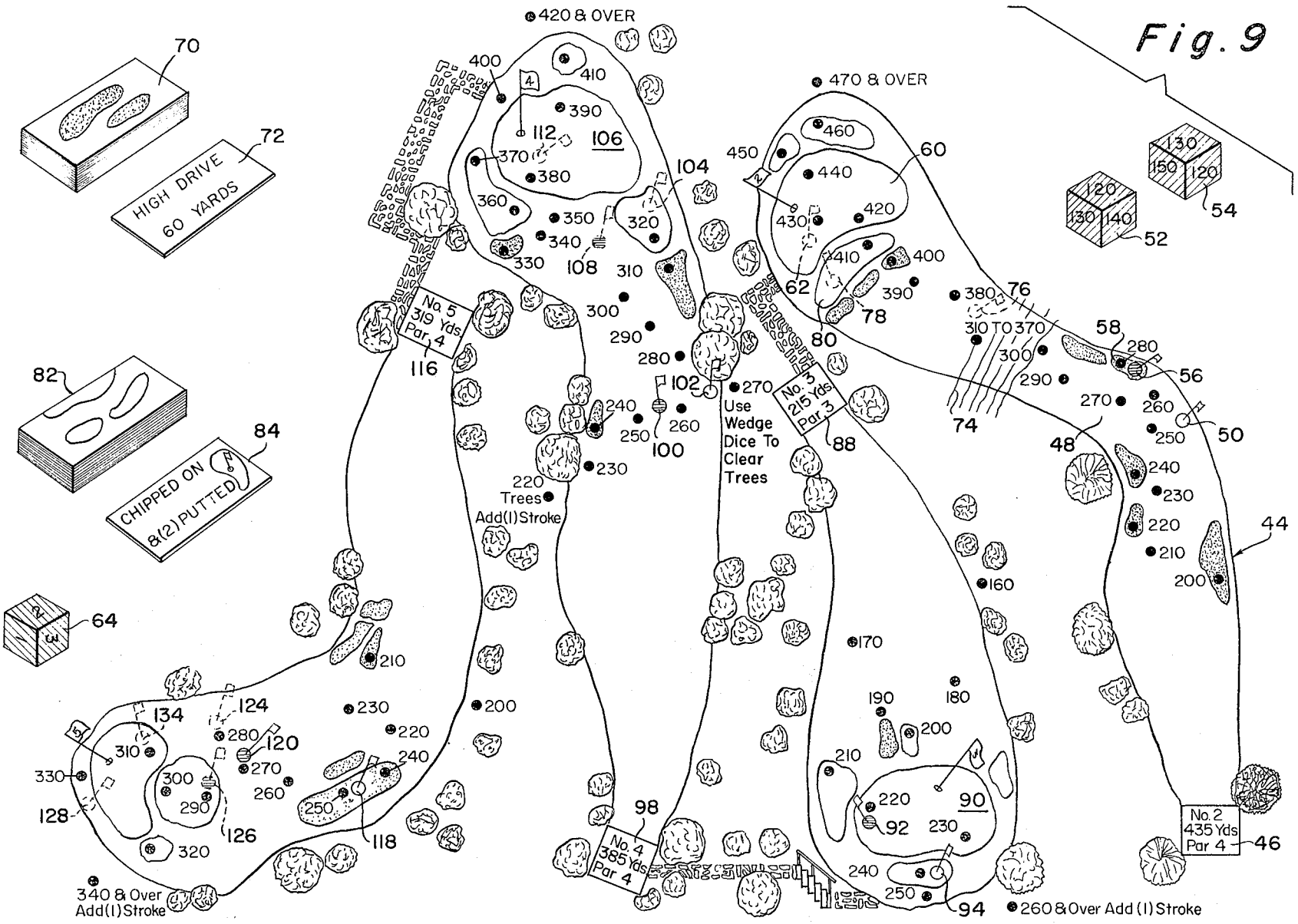
FIG. 9 shows a portion of the game board as it would appear during the course of play.

In FIG. 9, the play of the game illustrating play of holes 2 through 5 is shown. From one to four players can participate in the game, but for purposes of explanation, play of two players is shown and described.

Hole No. 2 is generally indicated at 44. The players game pieces are lined up at tee 46 prior to start of the play. The tee area of each hole gives the number, yardage and par of the hole. Hole No. 2 is a long 435 yard par 4 hole. As shown at 48, the hole takes a dog-leg to the left at about the 250 yard yardage-point. The player on observing this and recognizing the situation and yardage, would select his wood at this tee rather than an iron. In this instance, White, having the white token 50, has selected the brown wood dice 52 and 54 and rolled them to obtain his yardage and yardage point. The total of the two dice showing 250 yards enables the White player to move game piece 50 to the 250 yard point at the fairway as shown. This yardage of 250 yards in the lower portion of the mid-range for the brown dice, the range being from 240 to 300 yards.

The next player having the Blue game piece has rolled the brown wood dice and his game piece 56 is shown to have landed in the fairway trap 58 at the 280 yard point. The shot of 280 yards obtained by using the brown dice is at the upper end of the midrange of the yardage total that can be obtained by using the brown dice. FIG. 2 shows the brown dice with the 280 yard total.

White now looks to his second shot and notes that in order to land on the green 60, he must roll a yardage between 170 and 190 yards, and that this will require an iron shot. The white dice representing an iron and having a range of between 140 and 240 yards would be selected for White's next shot.

It should be noted that the layout of the hole and the yardage points themselves with their yardage markings are a guide to the player and assist him in making his club selection. Subtraction of the yardage at the instant position from that of the green gives the desired yardage. White's second shot is made with the white iron dice, and assuming a roll of 180 yards as shown on the dice 24 and 25 of FIG. 3 is made, White's game piece would be advanced to 62 adjacent the 430 yard yardagepoint, on the green.

When the player lands on the green he is entitled to immediately take the putting die and roll it to determine the number of putts required to sink his ball. Assuming that White would then take his turn and roll and the green putting die 64 shows a numeral 2 on its upper face; White would then have landed on the green in two shots and sunk his ball with two putts giving him a total of four strokes or a par 4 for the hole.

FIG. 10 shows a scorecard 66 for the White and Blue players and the number of strokes of White, in this case four, is entered at 68 on the scorecard to show that White had four strokes for the No. 2 hole.

It would now be Blue's turn, and since he is in a fairway trap, he must select one of the set of Fairway Cards 70 for his shot. Assume that the top card 72 is selected, which indicates that Blue's second shot was 60 yards. The additional 60 yards added to the 280 yard figure would give a total of 340 yards, but note that this figure is between 310 and 370 which is shown to be a downwardly extending hill 74 so that the ball would receive the benefit of a roll down to the 370 yardage point, where the game piece as indicated in dotted outline at 76 would then be placed.

In order to reach the green 60, which has yardage points from 420 to 440, a shot of 50 to 70 yards is necessary to land on the green, and Blue could select the pair of red wedge dice to roll for his yardage. Assuming that the roll of the dice gave him a roll of 40 as shwn on the red wedge dice 26 and 28 of FIG. 4, the game piece would be placed, as indicated at 78 in dotted outline, in the green trap 80 in which the 410 yardage point is located. Blue would then for his next shot take one of the set of Green Trap Cards 82. Assuming that card 84 was selected by Blue, it would indicate that for his fourth stroke, he chipped on the green, and then 2 putted, giving him a total of 6 strokes for hole No. 2. This score would then be entered on the scorecard 66 at 86 as shown in FIG. 10.

The game pieces are advanced to the tee of the next hole, in this instance hole No. 3 at 88, immediately after a player has "holed out."

The third hole is a short hole, and introduces a variation in the game that has added interest — the possibility of getting a hole-in-one. Hole No. 3 is a 215 yard par 3 hole. The green 90 has two yardage points at 220 and 230 yards which can be reached by combining the iron and wood dice. Whenever such a situation exists, there is a possibility, under the rules of the game, of obtaining a hole-in-one, since the game rules in such situations allow a player after driving onto the green to immediately take up the putting die and roll the putting die. The number on the putting die gives the total number of strokes for the hole.

In this situation the yardage is such that the minimum yardage of 240 yards on the brown wood dice would be beyond the green. The two white iron dice yardage values will be short of the green. To cover the in-between range, the player is permitted to use one brown die and one white die as an iron, and in this case yardage values will extend from 190 to 270 yards, with almost half of the possible combinations lying between 210 and 240 yards.

Assuming that Blue selects the brown-white dice combination for his iron and rolls a total value of 220, he will then have landed on the green 90 at the 220 yardage point where his game piece 92 is shown. Assuming that he next takes the putting die and rolls a 1, giving him a total of only 1 stroke for the hole, he gets a hole-in-one on the third hole.

Assuming that White for his tee shot also uses the brown-white dice combination for his iron shot from the tee and rolls a 240 total, his game piece 94 will be placed in the green trap containing the 240 yard yardage point; and assuming that he selects a card from the set of Green Trap Cards 82 which states that he chipped on the green and two putted, he receives a four for the hole. White's total of four strokes is then entered on the scorecard 66 for the third hole as shown at 96 next to the 1 stroke total previously entered on the scorecard 66 for Blue.

In this instance, White happened to draw a Green Trap Card which gave the number of strokes a good player would probably require to hole out after hitting the trap. However, a check of the captions on each of the 16 cards in the set of Green Trap Cards will show that there are cards which would have given White either a higher or a lower score. A sufficiently large number of cards is included in each set of trap cards to include more possibilities to add interest and to preclude the players from having any idea as to what cards might turn up.

Hole No. 4 as shown at the tee 98 is a 385 yard par 4 hole which has a narrow fairway with trees to the left and right. Blue's first shot as shown by his token 100 was straight down the middle to the 260 yardage point, while White's tee shot was a little bit longer and off to the right at the 270 yard yardage point. White, according to the instructions on the board, will be required to use the wedge dice to clear the trees on the right side of the fairway. Assuming that White rolls the red wedge dice for 50 yards, his shot will put him in the green trap containing the 320 yardage point as shown at 104.

Blue, at 260 yards and lying between 120 and 130 yards from the green 106, has a short iron shot. The combination of red and white dice gives a yardage range of from 80 to 170 yards, but a very heavy percentage of the yardage totals will be in the 80 to 110 yard range, which would give him a good approach shot with a lie probably only a few yards short of the green. Assuming a very low throw of the red-white dice for a short yardage of only 80 yards, Blue would advance along the fairway to the yardage point at 340 yards.

Assuming that White draws card 42 of FIG. 8 from the stack of Green Cards 82 on the board, which states that he got a beautiful shot from the trap and landed only three feet from the pin, and then 1 putted, White would hole out with a par 4.

Blue, for his shot to the green would have a wedge dice short for 40 to 50 yards and the roll gives him a 40 yard total which would place him on the green as shown at 112 at the 380 yard yardage point. Assuming a putting die roll showing two putts, Blue finishes the hole with a 1 over par 5 stroke total which is entered on the scorecard 66 at 114.

The play on hole 5, which is a par 4, 319 yard hole, illustrates the use of the red chipping dice (wedge dice).

Assuming that White leads off from the tee 116 with his wood dice and casts a 250 yard total, he will end up in the fairway trap at the 250 yard yardage marker at 118. Blue, using the brown dice also, rolls a 270 yard total and advances his piece shown at 120 to the 270 yard yardage point immediately in front of the green.

The second shot for White would involve selection of a Fairway Trap Card, and assuming that the selection is made and he draws a card stating "Oops! Missed Ball — Add (1) . . . Take Card," White would add a stroke. Assuming that the second Trap Card selected for White's third shot reads "Good Shot 30 Yards", White's playing token would be advanced to a point indicated in dotted outline at 124 adjacent the 280 yard yardage point.

Blue's position on the fairway immediately in front of the green at 120 gives him a good approach shot since he needs only 40 yards to reach the green. The two red chipping dice provide the best selection of a club. Assuming that Blue makes this selection, hoping to hit the mid-range of 30 to 50 yards, he would be in a good position to hole out, with a follow-up of a single roll of a single red die to put him on the green. Assuming that Blue makes the roll of his red dice in this instance, and unfortunately hits the lowest roll of 20 yards, he would land in the green trap at the 290 yard yardage point and his playing piece would be advanced to the position shown in dotted outline at 126 immediately beside the green.

White's approach shot, which is thirty yards off the green at 124, gives him somewhat of a problem in selection of clubs. If the two red dice are used, his shot can go anywhere from 20 to 80 yards. If he selects a single red die he can go as far as 40 yards, but two-thirds of the possibilities would put him in the green trap with Blue. Selection of the two red dice would be better in this instance, since 30 of the 36 possibilities with these dice would give him a yardage value of from 20 to 50 yards. The odds of landing on the green, however, with a roll of a 30 yard value, are the same, one in six for both dice choices. Assuming that White elects to play the two red dice, to avoid the traps with a possibly high yardage roll, for his fourth shot he rolls a 50 yard chip shot over the green placing him at the 330 yard yardage point on the far side of the green as indicated in dotted outline at 128.

For the third shot of Blue, a Green Trap Card from the set of Green Trap Cards 82 would be selected. Assuming in this case that Blue's luck is not too good and he selects the trap card 130 of FIG. 8 stating that his shot ended on the edge of the green, but he 3 putted, Blue must settle on this hole for a disappointing 7 score which is entered as shown at 132 on the scorecard 66.

Now, assuming that White, positioned as shown at 128 adjacent the green, selects one single red die for his green shot, and rolls, getting 20 yards, this puts him on the green (dotted outline) at 134 adjacent the 310 yard yardage point. And then, assuming his roll of the putting die gives him 2 putts, White ends up with a score of 7, tying Blue's score for the hole.

Play on one of the more difficult holes, specifically hole No. 12, which is a large water hole shown at the top of FIG. 1, is illustrated in FIG. 11.

The tee area 138 carrying the hole number, yardage and par, the same type of information which is shown on the board for all holes on the course, shows this to be a lengthy and difficult hole. The immediate problem encountered for this hole is the large body of water 140 which crosses the middle of the fairway. The player has an option of taking a chance on getting a long drive which will land on the island or of playing it safe and using his irons to get a lie of the ball short of the water. Assuming in this situation that White decides to take a chance on getting the higher yardage with his woods, and rolls with the brown dice, obtaining a total yardage of 270, White's game piece would be advanced to the 270 yard yardage point as shown at 142, but inasmuch as that is water area, White, according to the directions, must return his game piece to the position noted in dotted outline at 144 adjacent the 220 yard yardage point and add a stroke to his score.

Assuming that Blue played the hole cautiously, electing an iron rather than a wood shot off the tee, and selected one brown and one white dice combination to bring him as close to the water as possible with only a two out of nine possibility of landing in the water, and that he rolled a 200 yard total, this placed his game piece as shown at 146 adjacent the 200 yard yardage point, only 20 yards behind White's position.

The next shot for both players requires a club that will carry about 200 yards to clear the water and to land on the green. The best selection of a club here would be a long yardage iron represented by the brown and white dice combination. Assuming White rolls the brown-white dice and obtains a total of 200 yards as his third shot, he would land on the green as indicated in dotted outline at 148 adjacent the 420 yard yardage point, putting him on the green in 3.

Assuming that Blue also selects the long iron brown-white combination of dice and rolls the lowest value of 190 yards, he would land (dotted outline) at 152 adjacent the 390 yard yardage point. Blue would then require an additional 30 yards to get on the green. If the red die were used, the chances of rolling the additional 30 yards to the 420 yardage point on the green would only be one in six, the same as if two red dice were used. However, since there are three ten yard faces on the single red die, Blue would probably do better to roll two red dice, giving him a much better chance of getting close to the 420 yard mark, since two-thirds of the possibilities with two red dice would either put him on the green or within ten yards of it. The worst that Blue could do would be to roll a 50 yard combination which would put him in the green trap at the 440 yard mark, as indicated at 154. More likely, he would be on the green in either three or four and have a chance to offset White's remarkably good fortune in landing directly on the green with his 200 yard long iron shot.

This hole emphasizes the choices presented to a player on a regular course, where he can either gamble for a very good, against the odds shot, or play for a conservative surer score. From the foregoing, it can be seen that this game presents to the board player the problems encountered on the regular golf course, and that the player must evaluate the situation and make a decision based upon the yardage desired, hazards to be avoided, and yardage to be expected from a given club as represented by collective dice.

It can be seen that the game proposed comes closer to duplicating on a game board the actual true game of golf as played on the course than any game heretofore proposed.

The board itself accurately portrays the shape, location and hazards on each hole, exactly as they would appear on a regular golf course, eliminating all artifical and unreal appearing markings which have had to be introduced on the boards of golf games heretofore suggested.

The use of yardage points in incremental distances of 10 yards between the tee and the pin in typical places where a ball might come to rest serve to guide the player in club selection and to expedite play of the game.

Both chance and judgment are factors in a player's success, since the correct dice must be selected to give either the yardage desired or to avoid hazards such as traps or trees.

Two dice are selected by the player and represent yardages that may be rolled, these yardages being typical yardages that could be expected when a corresponding club is used on a regular golf course. In this manner, golf experience is a factor in playing of the game, and conversely play of the board game presents those situations which normally would occur and could be expected by a player on a typical golf course.

The pairs of brown, white, and red dice respectively represent woods, long iron, and short iron shots, and mixing of these dice provide the player with the range of yardage values given by a typical set of clubs. The single red die representing a wedge and the single green putting die representing the putter give the play of the game additional versatility.

These circumstances and penalties encountered closely duplicate real play of the game.

Additional realism and variety, stricly as a matter of chance, are added to the game by the use of the set of Fairway Trap Cards and the set of Green Trap Cards.

The combination of the various features of the game provides a readily understood and playable game for young and old, in which there is both realism and variety without undue complexity. The game can be played by eight and nine year olds. Elimination of complex methods of determining ball position and use of yardage points and trap cards, as well as a putting die for the number of putts on the green, expedite play so that a game played by four persons can be completed in slightly over an hour.

These and other features and advantages of this invention will be readily apparent to those skilled in the art.

While this invention has been described, it will be understood that it is capable of further modification, uses and/or adaptations of the invention following, in general, the principle of the invention and including such departures from the present disclosure as come within known or customary practice in the art to which the invention pertains, and as may be applied to the essential features hereinbefore set forth, and fall within the scope of the invention or the limits of the appended claims.

What is claimed is:

1. A golf board game apparatus, comprising:

a. a game board having a complete golf course showing the features and layout of each hole including terrain, natural hazards, tee, pin, disposition and shape of fairway and green traps, and shape of the green, as such would appear on a conventional golf course, b. each hole having a plurality of different incrementally spaced and noted yardage points each disposed at a different yardage location on a given hole between tee and pin, and on any one of which a ball may come to rest after the player takes a stroke, c. the yardage points being positioned along the fairway, in the traps, and on the green and having a number disposed adjacent thereto which corresponds to the yardage distance from the tee to that yardage point, d. a plurality of advancing means for moving the ball toward the pin, any one of which may be selected in the judgment of the player, depending on the ball location at that time, each advancing means showing the total yardage value of the stroke taken, and having a range of yardage values to reflect that obtained with a given type of club, e. each advancing means providing a combination of numbers covering a different range of values and where the more typical values in the range for the given club are likely to occur, and at least three yardage values have different probabilities of occurrence, f. a set of at least ten chance cards associated with the fairway traps for giving the result of the player's shot from the traps, g. a set of at least ten chance cards associated with the green traps for giving the results of the player's stroke from the trap with respect to movement of the ball towards the green and possible holing out.

2. The golf board game apparatus as set forth in claim 1, wherein:

a. each advancing means includes a pair of dice, and wherein each die has at least two faces with identical values thereon.

3. The golf board game apparatus as set forth in claim 2, wherein:

a. at least one pair of dice gives a combination of at least ten different yardage values with a probability of a given number turning up from one in four to one in 10 chances.

4. The golf board game apparatus as set forth in claim 3, wherein:

a. wood clubs are represented by a pair of dice representing one of the advancing means, and which have a yardage range value of from 240 to 300 yards, b. the yardage totals of 250, 260 and 270 yards each having a probability of turning up one out of four chances, c. the 280 yard total having a chance of turning up on five out of 36 chances, the 240 yard total having a possibility of turning up on one of nine chances, d. the yardage total of 290 yards having the possibility of occurring on two occasions of 36 possibilities, while the 300 yard total has a possibility of occurring on one in 36 chances.

5. The golf board game apparatus as set forth in claim 2, wherein:

a. the advancing means includes plural pairs of dice, each pair giving different yardage ranges, and wherein one die of a given pair of dice may be combined with a die of another pair of dice, the total yardage obtained from such combination compatible with the yardage points on the board.

6. The golf board game apparatus as set forth in claim 2, wherein:

a. the advancing means includes a putting die which is rolled after the player lands on the green to obtain the total number of putts.

* * * * *